US008770680B1

(12) United States Patent
Chen et al.

(10) Patent No.: US 8,770,680 B1
(45) Date of Patent: Jul. 8, 2014

(54) LOCK DEVICE FOR TWO-WAY TRAVEL DRAWER

(71) Applicants: Kung-Cheng Chen, Taichung (TW); Lung-Chuan Huang, Taichung (TW)

(72) Inventors: Kung-Cheng Chen, Taichung (TW); Lung-Chuan Huang, Taichung (TW)

(73) Assignee: E-Make Co., Ltd., Taichung (TW)

( * ) Notice: Subject to any disclaimer, the term of this patent is extended or adjusted under 35 U.S.C. 154(b) by 0 days.

(21) Appl. No.: 13/804,988

(22) Filed: Mar. 14, 2013

(51) Int. Cl.
*E05C 7/06* (2006.01)

(52) U.S. Cl.
USPC ..... 312/221; 312/286

(58) Field of Classification Search
USPC ..... 312/215–222, 319.1, 283, 286; 292/137, 138, 340, DIG. 40, DIG. 18
See application file for complete search history.

(56) References Cited

U.S. PATENT DOCUMENTS

| | | | | | |
|---|---|---|---|---|---|
| 3,764,190 | A * | 10/1973 | Anderson | 312/286 |
| 4,480,883 | A * | 11/1984 | Young | 312/220 |
| 4,768,844 | A * | 9/1988 | Ludwig | 312/221 |
| 4,889,396 | A * | 12/1989 | Mitchell et al. | 312/221 |
| 4,936,640 | A * | 6/1990 | Pratzer | 312/221 |
| 5,056,877 | A * | 10/1991 | Westwinkel | 312/221 |
| 5,074,627 | A * | 12/1991 | Broeders | 312/221 |
| 5,176,436 | A * | 1/1993 | Mitchell | 312/221 |
| 5,599,078 | A * | 2/1997 | Dechene et al. | 312/221 |
| 5,702,167 | A * | 12/1997 | Muller | 312/221 |
| 5,772,294 | A * | 6/1998 | Hendrich et al. | 312/221 |
| 5,829,859 | A * | 11/1998 | Cram | 312/221 |
| 5,997,114 | A * | 12/1999 | Bischoff | 312/215 |
| 6,082,839 | A * | 7/2000 | Chiku | 312/219 |
| 8,511,765 | B1 * | 8/2013 | Chen et al. | 312/333 |
| 8,651,591 | B1 * | 2/2014 | Chen et al. | 312/218 |
| 2004/0051425 | A1 * | 3/2004 | Chen | 312/217 |
| 2005/0023942 | A1 * | 2/2005 | Kunanantakul | 312/221 |
| 2006/0066187 | A1 * | 3/2006 | Chang | 312/219 |
| 2006/0197416 | A1 * | 9/2006 | Tsai | 312/217 |
| 2008/0054768 | A1 * | 3/2008 | Lin | 312/221 |
| 2008/0231150 | A1 * | 9/2008 | Grela et al. | 312/218 |
| 2009/0160298 | A1 * | 6/2009 | Chen et al. | 312/333 |

* cited by examiner

*Primary Examiner* — Hanh V Tran

(57) ABSTRACT

A lock device for two-way travel drawers of a support body, including in combination pegs each on one side of the drawer; a plurality of two slides each on either side of the drawer; and a lock assembly longitudinally mounted on one side of the support body and including a groove member, a sliding member, a biasing member, a lock, and snapping members. The groove member includes front and rear flanges, and an upward bend on an upper portion. The sliding member is slidably disposed in the groove member and includes longitudinal sets of two flush openings, and an upper hook. The biasing member interconnects the bend and the hook. The lock is on an upper portion of the support body for stopping the sliding member. The snapping member includes a central bottom trough and two inclined surfaces each extending from the trough to either end latch.

7 Claims, 8 Drawing Sheets

LOCK DEVICE FOR TWO-WAY TRAVEL DRAWER

BACKGROUND OF THE INVENTION

1. Field of the Invention

The invention relates to drawer slides and more particularly to a lock device for a two-way travel drawer.

2. Description of Related Art

A drawer is a box shaped container that fits into a piece of furniture in such a way that it can be drawn out horizontally to access its contents. However, typical drawers are designed to open or close from a front end of the drawer but not from either the front end or the rear end of the drawer.

A conventional two-way travel three section slide drawer slide assembly for permitting a drawer to be selectively pulled out from opposite open ends of a compartment of a cabinet, comprises in combination an elongated outer section comprising a flat track threadedly secured to the compartment, and two sets of two projecting stop elements wherein the stop elements of either set are opposite and formed on one of two lengthwise curved edges of the track of the outer section; an elongated intermediate section disposed in the outer section and comprising a flat track, two engaging members at both ends respectively, and two sets of two projecting stop members wherein one set of stop members is proximate to the engaging members at one end, and the other set of stop members is proximate to the engaging members at an other end; two elongated sliding members each slidably disposed either between upper edges of the outer section and the intermediate section or between lower edges of the outer section and the intermediate section wherein each sliding member is limited to travel in a distance between the stop members of one set and the stop members of the other set; an elongated inner section releasably secured to the drawer and comprising a two-end open flat track, an intermediate opening, two positioning members at both ends of the intermediate opening respectively, and two lanced out tabs each spaced from the positioning member; an elongated bearing member disposed between the intermediate section and the inner section; two stop units releasably secured to the engaging members respectively, each stop unit comprising two bent projections on upper and lower edges respectively, two flanges extending from the upper and lower edges respectively but opposing the adjacent projection, each flange including an inclined first surface at one end and an inclined second surface at an other end, and two horizontal sliding members each extending from one edge of the adjacent projection, each sliding member including a cavity at one end; and a flexible limit member comprising an intermediate flat portion adjacent to the intermediate opening, the limiting member further comprising, on either end of the flat portion, a latching member including an inclined surface at one end and an inclined extension at an intermediate portion, a ramp formed on the latching member, a slot abutted on the ramp, and a cut at an other end of the latching member distal the slot.

However, the conventional drawers tend to malfunction. Furthermore, its components are complicated.

Thus, the need for providing a drawer having two slide assemblies for allowing the drawer to selectively draw out or pull back from one of two opposite directions of a support body (e.g., desk, cabinet, or the like) still exists.

SUMMARY OF THE INVENTION

It is therefore one object of the invention to provide a lock device for a plurality of two-way travel drawers of a support body, comprising in combination a plurality of pegs each disposed on one side of the two-way travel drawer; two two-way travel slides each disposed on an outer surface of either side of the two-way travel drawer; and a lock assembly longitudinally mounted on one side of the support body and comprising a groove member, a sliding member, a biasing member, a lock, and a plurality of snapping members wherein the groove member has an n-shaped section and includes front and rear flanges, and an upward bend on an upper portion proximate to the rear flange; the sliding member has an n-shaped section and is disposed in the groove member, the sliding member includes a plurality sets of two flush openings arranged longitudinally on front and rear corners, and an upper hook; the biasing member interconnects the bend and the hook so that the sliding member is capable of sliding about the groove member; the lock is disposed on an upper portion of an inner surface of one side of the support body for stopping the sliding member from moving out of its confined range; and each of the snapping members includes two latches on front and rear ends respectively to be retained in the flush openings, a central trough on a bottom, and two inclined surfaces each extending from the trough to either latch; wherein in an unlocked position of the two-way travel drawer the lock is disposed horizontally and the peg is urged against the inclined surface; wherein a pushing of the two-way travel drawer into the support body until the peg moves along the inclined surface to a position passing a lowest point of the inclined surface with the biasing member expanded and the sliding member pushed upward; wherein compression of the biasing member pushes the sliding member downward to tightly press the trough on the peg for positioning; and wherein a turning of the lock locks the sliding member.

The above and other objects, features and advantages of the invention will become apparent from the following detailed description taken with the accompanying drawings.

DETAILED DESCRIPTION OF THE INVENTION

Figure 1:
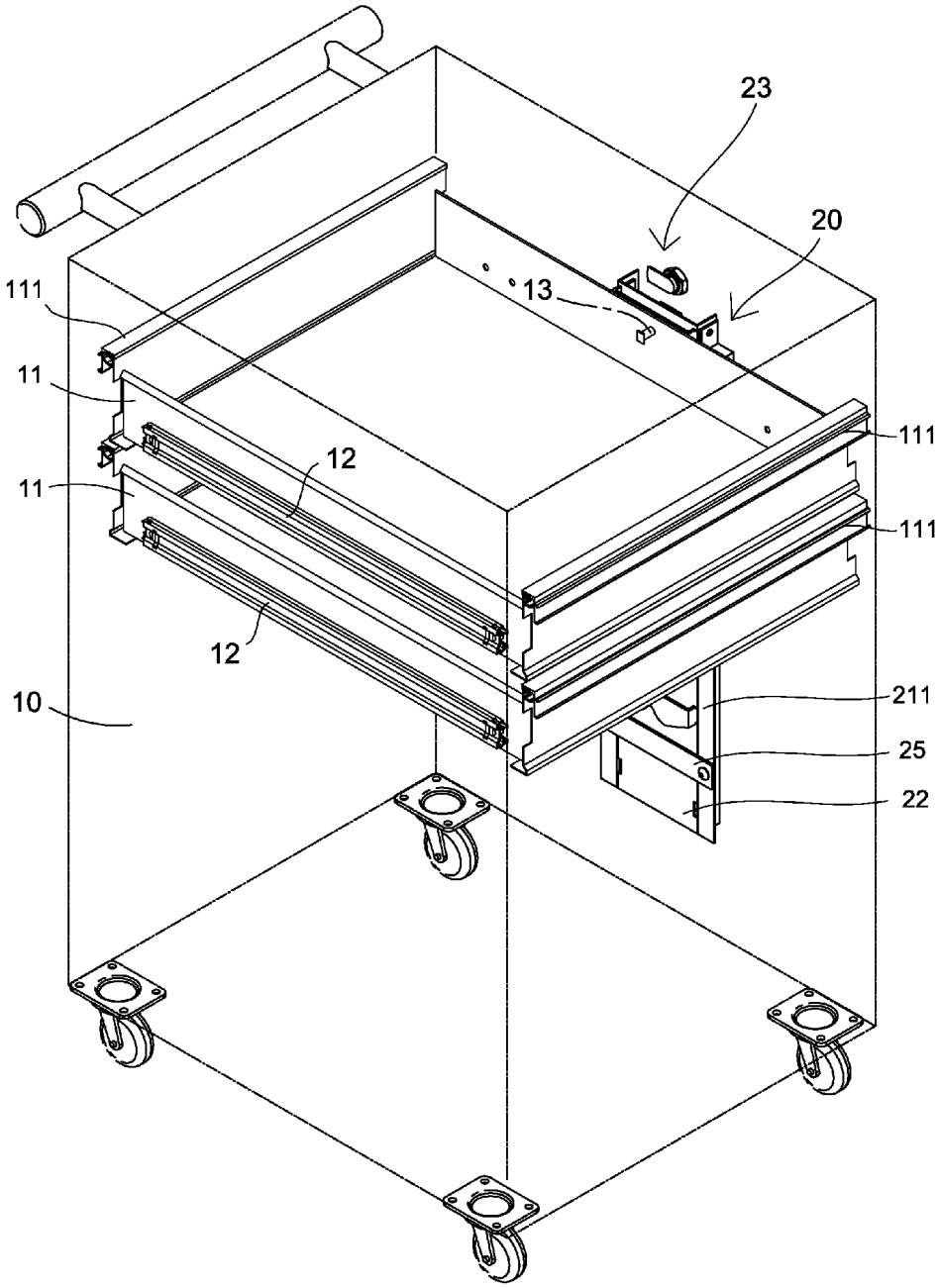
FIG. 1 is a perspective view of a cart having a plurality of two-way travel drawers incorporating a lock device according to the invention.
Figure 2:
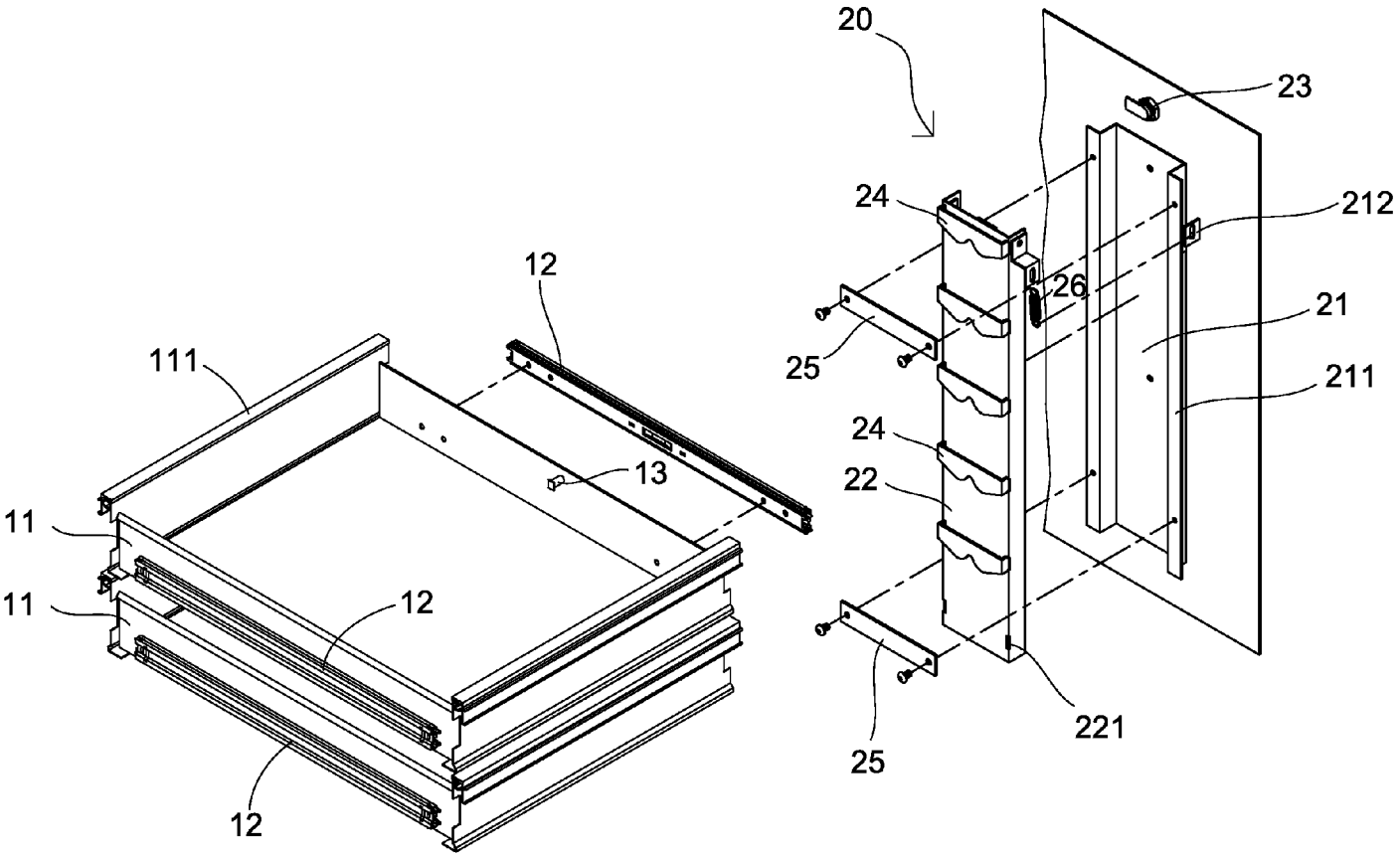
FIG. 2 is an exploded perspective view of the lock device with the associated slide detached from the drawer side.
Figure 3:
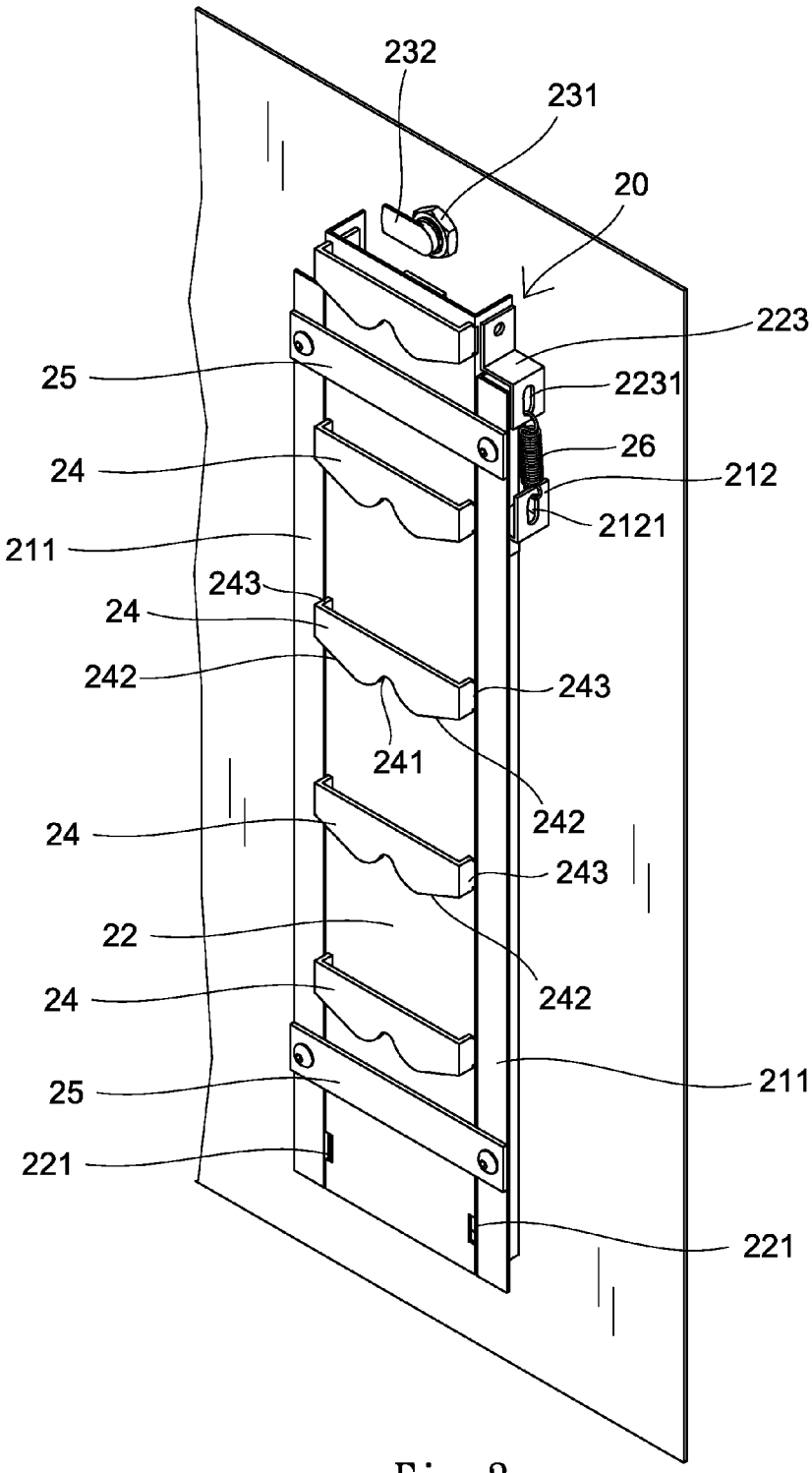
FIG. 3 is a perspective view of the assembled lock device of FIG. 2.
Figure 4:
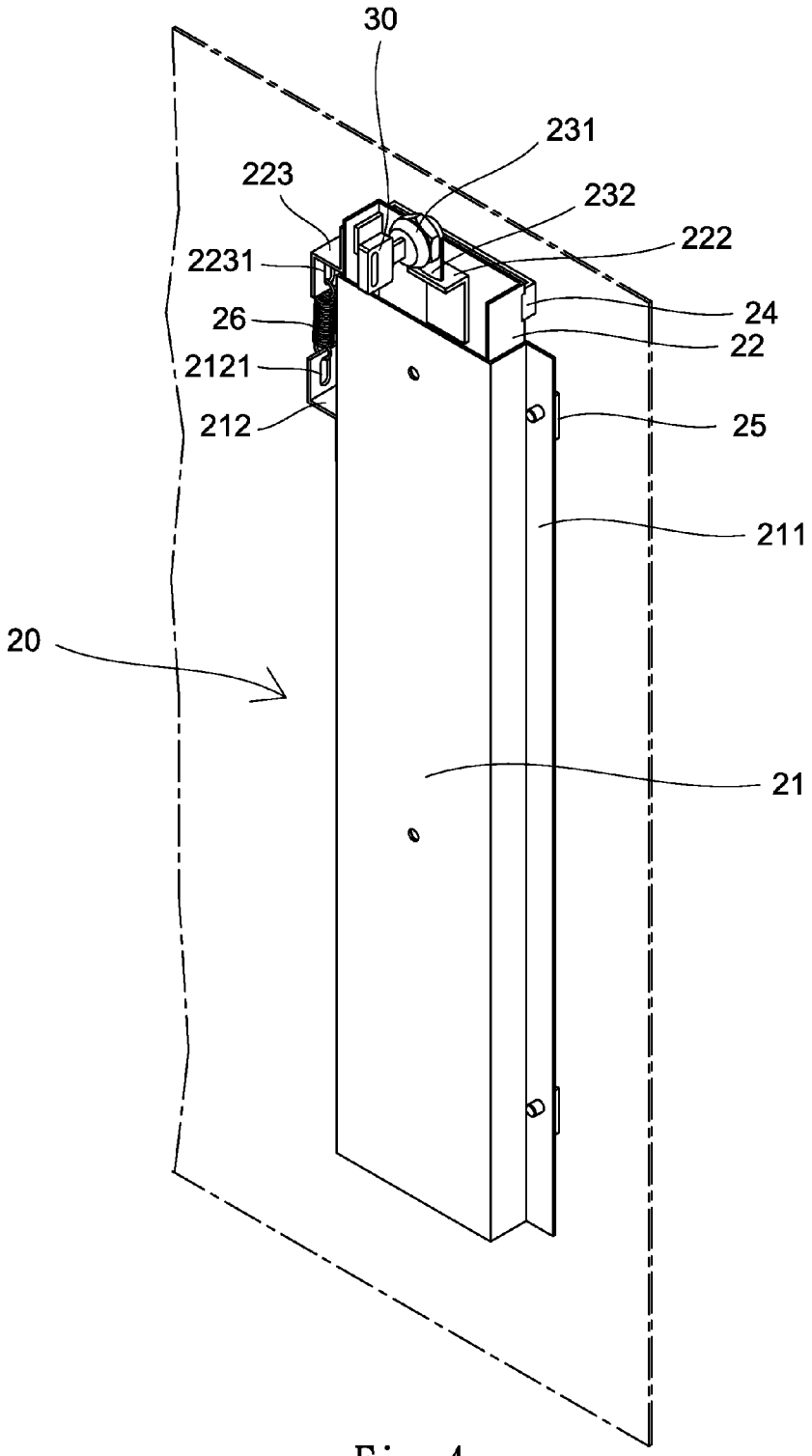
FIG. 4 is a perspective view of the lock device of FIG. 3 but viewing from an opposite angle.
Figure 5:
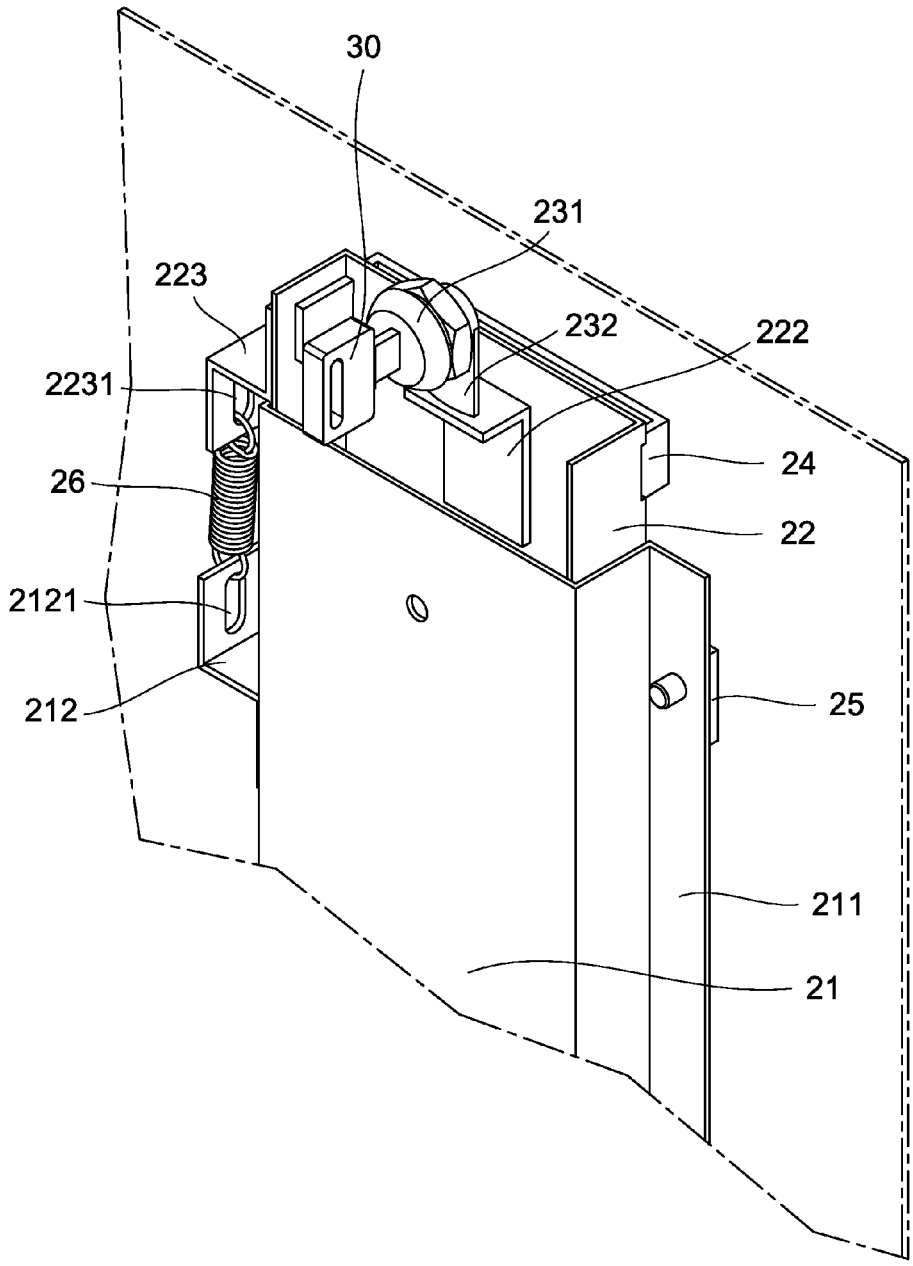
FIG. 5 is an enlarged view of an upper portion of FIG. 4.

Referring to FIGS. 1 to 8, a lock device for a two-way travel drawer in accordance with the invention is shown and comprises in combination following components.

A cart 10 is a hollow structure having a plurality of drawers 11 disposed vertically. A peg 13 is provided on a central portion of one side of each drawer 11. A slide (e.g., two-way travel slide) 12 is lengthwise provided on an outer surface of each side of the drawer 11. The drawer 11 has a handle 111 on a top edge of each of front and rear ends.

A lock assembly 20 is longitudinally mounted on one side of the cart 10 and comprises a longitudinal groove member 21, a sliding member 22, a lock 23, and a plurality of snapping members 24.

The groove member 21 has an n-shaped section and comprises front and rear flanges 211, and an upward bend 212 on an upper portion of a rear edge, a through hole 2121 through a vertical section of the bend 212. The sliding member 22 has an n-shaped section and is shaped to slidably dispose in the groove member 21 by threadedly driving a plurality of fasteners (not numbered) through a plurality of inner, rectangular plates 25 and the front and rear flanges 211. The sliding member 22 comprises a plurality sets of two flush, rectangular openings 221 arranged longitudinally on front and rear corners, an upper, bent stop member 222, an upper hook 223 on a rear edge, and a through hole 2231 through a lower, vertical section of the hook 223. A torsion spring 26 has one end fastened in the through hole 2231 and an other end fastened in the through hole 2121. Thus, the sliding member 22 may slide about the groove member 21 by expanding or compressing the spring 26.

The lock 23 is disposed on an upper portion of an inner surface of one side of the cart 10 and served as a stop of the sliding member 22 in an upward movement of the sliding member 22. The lock 23 comprises a threaded nut 231 at on end mounted on the wall of the cart 10, and an arm 232 at an other end rotatably fastened in the nut 231.

The snapping member 24 comprises two latches 243 on front and rear ends respectively, a trough 241 on a central portion of a bottom edge, and two inclined surfaces 242 each extending from the trough 241 to either latch 242. The latches 243 are retained in the flush openings 221 of the same set. Thus, the snapping member 24 are secured to and equally spaced apart on an inner surface of the sliding member 22. It is envisaged by the invention that the snapping member 24 can be secured to any set of two flush openings 221 depending on height of the drawer 11 so that the drawers 11 can be replaced easily.

Figure 6:
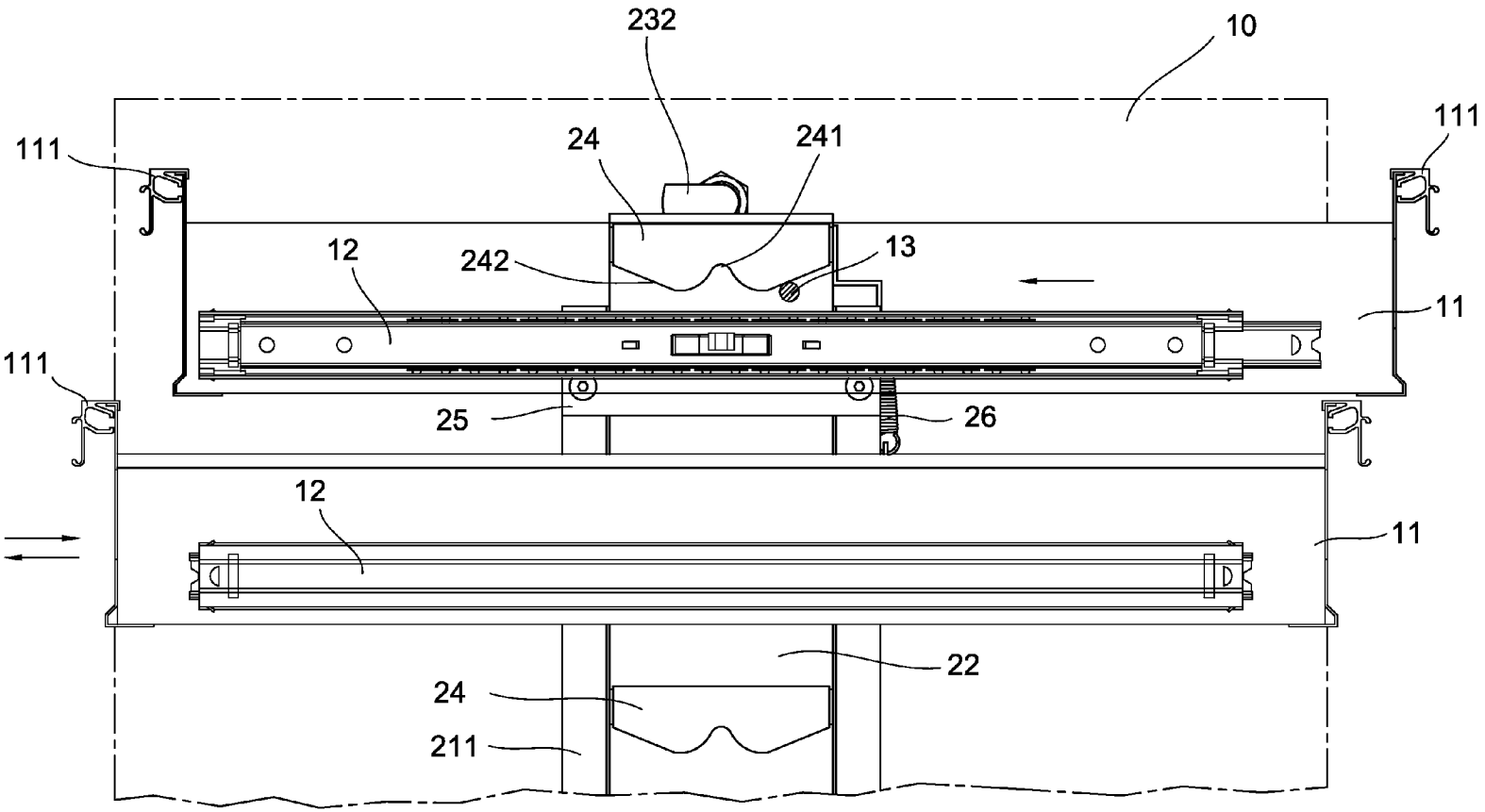
FIG. 6 is a side elevation showing the drawer being unlocked.
Figure 7:
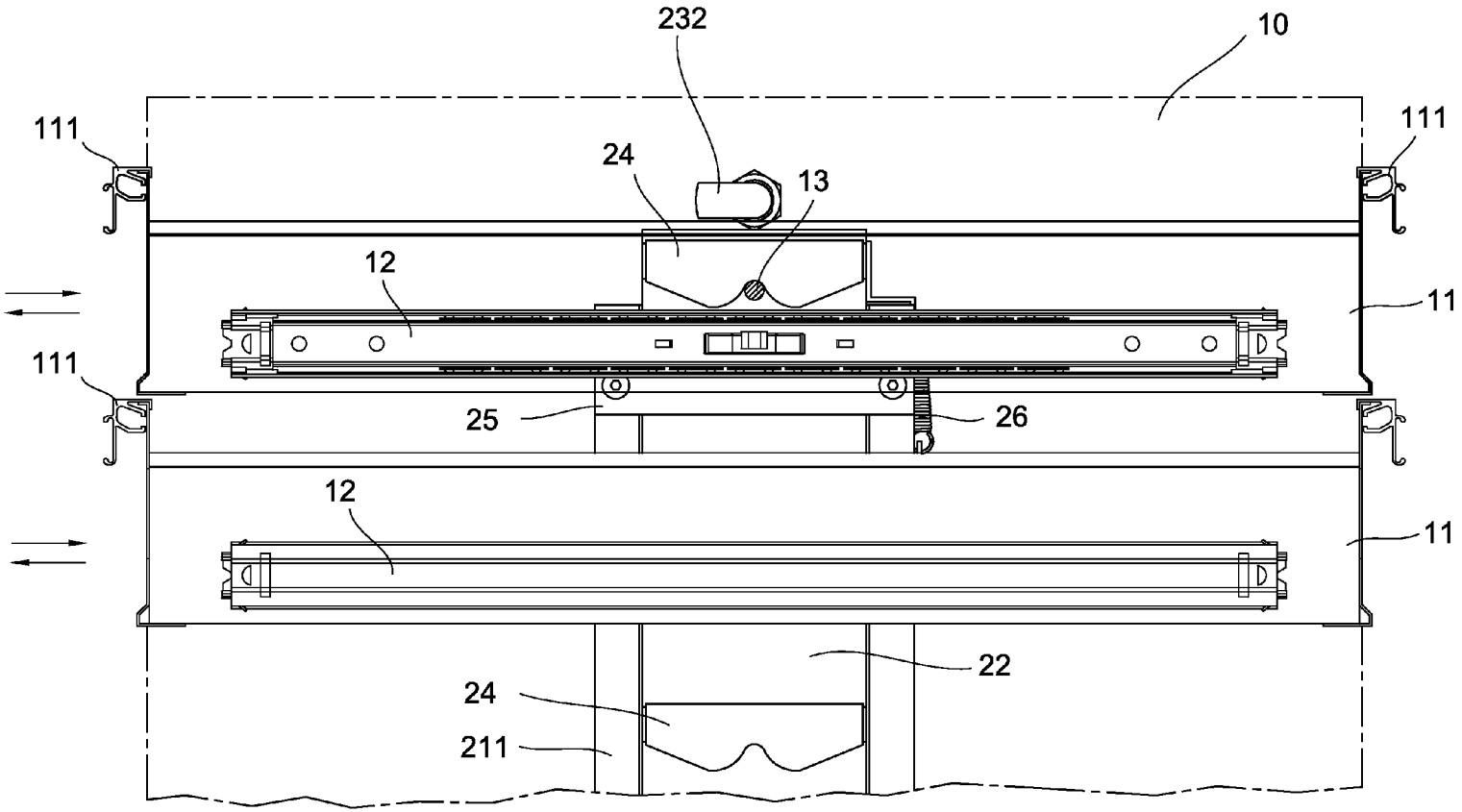
FIG. 7 is a view similar to FIG. 6 showing an operation of locking one drawer by pushing the peg into the trough along the inclined surface of the snapping member.
Figure 8:
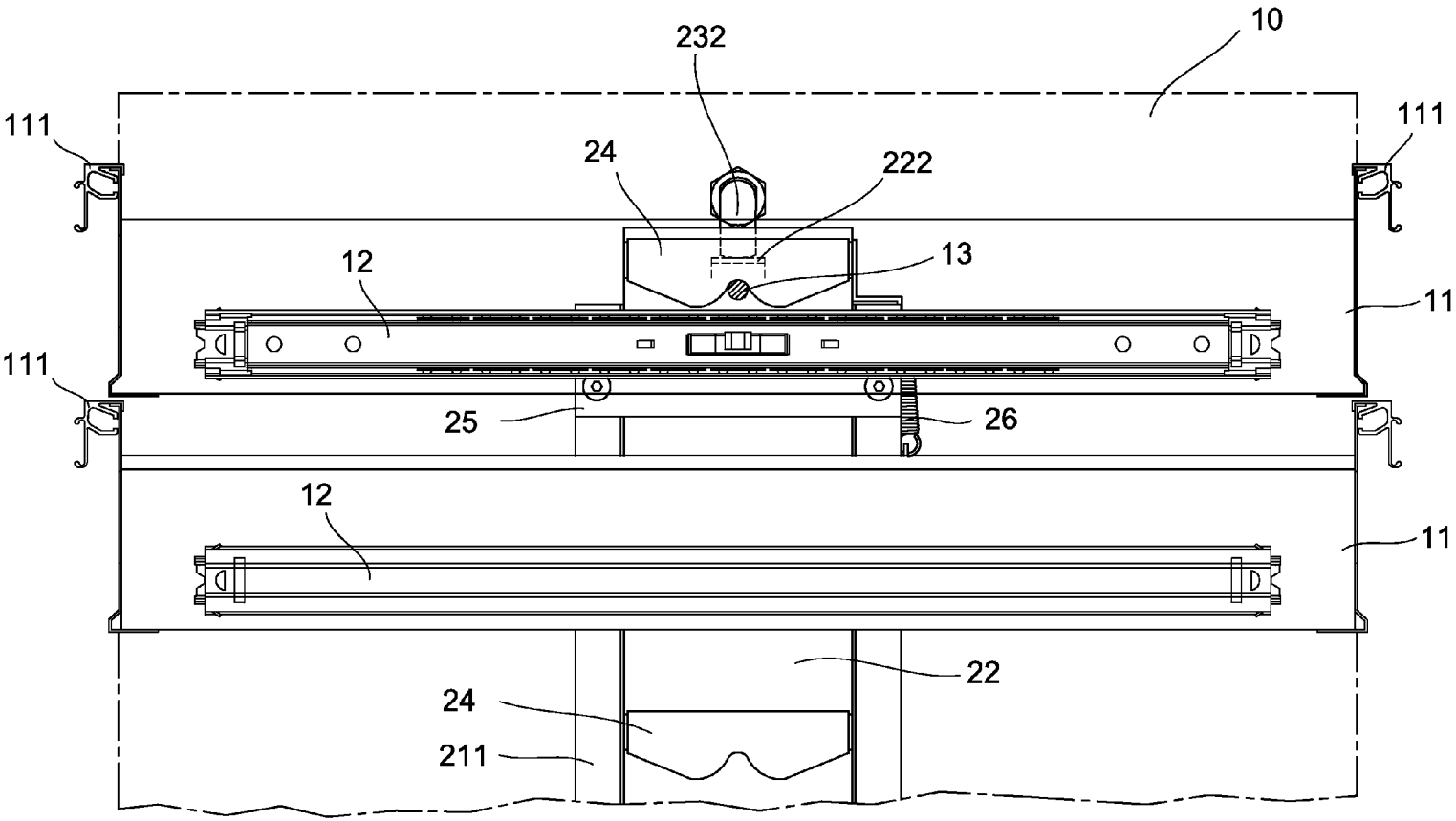
FIG. 8 is a view similar to FIG. 6 showing the drawer being locked by the snapping member by turning the lock of the lock device.

Locking and unlocking operations of the invention are detailed below. As shown in FIG. 6, the topmost drawer 11 is partially drawn out of a rear end of the cart 10 (i.e., unlocked). In this position, the arm 232 is disposed horizontally and the peg 13 is urged against the inclined surface 242. Further, an individual may push the topmost drawer 11 (as indicated by the topmost arrow) into the cart 10 until the peg 13 moves along the inclined surface 242 to a position passing a lowest point of the inclined surface 242 with the spring 26 expanded and the sliding member 22 pushed upward. Thereafter, the compression of the spring 26 pushes the sliding member 22 downward to tightly press the trough 241 on the peg 13 for positioning (see FIG. 7). For locking the drawer 11, the individual may insert a key 30 into the arm 232 and then counterclockwise rotate the arm 232 until being stopped (see from the position of FIG. 7 to that of FIG. 8). At this position, the top of the stop member 222 is urged against by the end of the arm 232. As a result, the topmost drawer 11 is locked.

While the invention has been described in terms of preferred embodiments, those skilled in the art will recognize that the invention can be practiced with modifications within the spirit and scope of the appended claims.

What is claimed is:

1. A lock device for a plurality of two-way travel drawers of a support body, comprising in combination:

a plurality of pegs each disposed on one side of the two-way travel drawer;

a plurality of two two-way travel slides each disposed on an outer surface of either side of the two-way travel drawer; and a lock assembly longitudinally mounted on one side of the support body and comprising a groove member, a sliding member, a biasing member, a lock, and a plurality of snapping members wherein the groove member has an n-shaped section and includes front and rear flanges, and an upward bend on an upper portion proximate to the rear flange;

the sliding member has an n-shaped section and is disposed in the groove member, the sliding member includes a plurality sets of two flush openings arranged longitudinally on front and rear corners, and an upper hook;

the biasing member interconnects the bend and the hook so that the sliding member is capable of sliding about the groove member;

the lock is disposed on an upper portion of an inner surface of one side of the support body for stopping the sliding member from moving out of its confined range; and each of the snapping members includes two latches on front and rear ends respectively to be retained in the flush openings, a central trough on a bottom, and two inclined surfaces each extending from the trough to either latch;

wherein in an unlocked position of the two-way travel drawer the lock is disposed horizontally and the peg is urged against the inclined surface;

wherein a pushing of the two-way travel drawer into the support body until the peg moves along the inclined surface to a position passing a lowest point of the inclined surface with the biasing member expanded and the sliding member pushed upward;

wherein compression of the biasing member pushes the sliding member downward to tightly press the trough on the peg for positioning; and wherein a turning of the lock locks the sliding member.

2. The lock device of claim 1, wherein the bend includes a through hole.

3. The lock device of claim 2, wherein the hook includes a through hole corresponding to the through hole of the bend.

4. The lock device of claim 3, wherein the biasing member has one end one end fastened in the through hole of the bend and an other end fastened in the through hole of the hook.

5. The lock device of claim 1, wherein the sliding member further includes an upper, bent stop member directly below the lock.

6. The lock device of claim 5, wherein the lock includes a threaded nut at one end mounted on one side of the support body, and an arm at an other end rotatably fastened in the nut so that a turning of the arm will be stopped when a top of the stop member is urged against by the arm.

7. The lock device of claim 1, further comprising a plurality of inner, rectangular plates threadedly secured to the front and rear flanges of the groove member.

* * * * *